US007943870B2

(12) United States Patent
Watanabe

(10) Patent No.: US 7,943,870 B2
(45) Date of Patent: May 17, 2011

(54) SWITCH DEVICE

(75) Inventor: Ryoji Watanabe, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 226 days.

(21) Appl. No.: 12/354,595

(22) Filed: Jan. 15, 2009

(65) Prior Publication Data

US 2009/0188780 A1 Jul. 30, 2009

(30) Foreign Application Priority Data

Jan. 29, 2008 (JP) ..... 2008-017511

(51) Int. Cl.
*H01H 9/26* (2006.01)

(52) U.S. Cl. ..... 200/5 A

(58) Field of Classification Search ..... 200/5 A, 200/5 R, 6 A, 4, 520
See application file for complete search history.

(56) References Cited

U.S. PATENT DOCUMENTS

| | | | | |
|---|---|---|---|---|
| 4,435,796 | A * | 3/1984 | Saito et al. | 368/321 |
| 6,525,280 | B2 * | 2/2003 | Chan et al. | 200/6 A |
| 2005/0139458 | A1 * | 6/2005 | Komatsu | 200/5 R |

FOREIGN PATENT DOCUMENTS

JP 10-197035 A 7/1998

* cited by examiner

*Primary Examiner* — Edwin A. Leon
(74) *Attorney, Agent, or Firm* — Roberts Mlotkowski Safran & Cole P.C.

(57) ABSTRACT

A switch device, includes a device main body incorporating a fixed pressure contact portion and includes a fixed sliding contact portion that forms a circuit together with the fixed pressure contact portion, and at least one pair of switches supported on the device main body, each switch comprising an operating knob. One switch of the at least one pair of switches includes a pressure-operated switch includes a movable pressure contact portion corresponding to the fixed pressure contact portion, and another switch includes a slide-operated switch includes a movable sliding contact portion corresponding to the fixed sliding contact portion.

8 Claims, 3 Drawing Sheets

SWITCH DEVICE

The present application is based on Japanese Patent Application No. 2008-017511 filed on Jan. 29, 2008, the entire contents of which are incorporated herein by reference.

BACKGROUND OF THE INVENTION

1. Field of the Invention

The present invention relates to a switch device, in more particular, to a switch device provided with a pressure-operated switch and a slide-operated switch.

2. Related Art

As a conventional switch device, JP-A-10-197035 discloses a switch device provided with a case having a display panel and various types of switches having an operating knob exposed on the display panel of the case.

Inside the case, the above-mentioned display panel is arranged on a switch operating side, and a circuit board mounting various types of switches as well as a control portion is housed.

The various types of switches are composed of a push switch and a rotary switch, etc., each operably supported on the circuit board and connected to a drive portion via a switch circuit and the control portion. The push switch is switched by a pressing operation of an operating knob thereof, and the rotary switch is switched by a pivotal operation of an operating knob thereof, respectively.

In the above-mentioned structure, the operating knob of the push switch or that of the rotary switch is push-operated or pivotally operated manually by an operator in order to implement a function of the desired drive portion. In this case, when the operating knob of the push switch or that of the rotary switch is push-operated or pivotally operated, the switching of the switches corresponding to each type of operating knob is carried out, and a switching signal is outputted from the switch to the control portion. The control portion outputs a driving signal to each type of drive portions based on the inputted switching signal. The drive portion inputs the driving signal from the control portion, thereby implementing the function thereof.

In the meantime, in this type of switch device, the push switch and the rotary switch are each provided with a movable pressure contact portion and a movable sliding contact portion, in addition, a fixed pressure contact portion and a fixed sliding contact portion each corresponding to the movable pressure contact portion and the movable sliding contact portion are provided on a circuit board. Among the above contact portions, a fixed contact portion of the rotary switch corresponding to a movable contact portion is generally coated with grease in order to ensure good pivotal operability (a sliding movement of the movable contact portion) of the operating knob.

However, according to the conventional switch device, since a fixed contact portion corresponding to the push switch (a movable pressure contact portion) and a fixed contact portion corresponding to the rotary switch (a movable sliding contact portion) are provided on a mutual circuit board, a portion of the grease moves on the circuit board due to an effect such as vibration, etc., after coating the grease, and reaches the fixed pressure contact portion from the fixed sliding contact portion, thus, the grease intervenes between the fixed pressure contact portion and the movable pressure contact portion, thereby causing a contact failure.

THE SUMMARY OF THE INVENTION

Therefore, it is an object of the invention to provide a switch device, by which it is possible to prevent grease from reaching a fixed contact portion corresponding to a movable pressure contact portion, thereby preventing generation of a contact failure due to the grease between a fixed pressure contact portion and a movable pressure contact portion. According to a feature of the present invention, a switch device comprises:

a device main body incorporating a fixed pressure contact portion and in a separate area comprising a fixed sliding contact portion that forms a circuit together with the fixed pressure contact portion; and at least one pair of switches supported on the device main body, each switch comprising an operating knob;

wherein one switch of the at least one pair of switches comprises a pressure-operated switch comprising a movable pressure contact portion corresponding to the fixed pressure contact portion; and another switch comprises a slide-operated switch comprising a movable sliding contact portion corresponding to the fixed sliding contact portion.

According to the invention, it is possible to prevent grease from reaching a fixed contact portion, thereby preventing generation of a contact failure due to the grease between a fixed pressure contact portion and a movable pressure contact portion.

BRIEF DESCRIPTION OF THE DRAWINGS

Next, the present invention will be explained in more detail in conjunction with appended drawings, wherein.

DESCRIPTION OF THE PREFERRED EMBODIMENT

Embodiment

Figure 1:
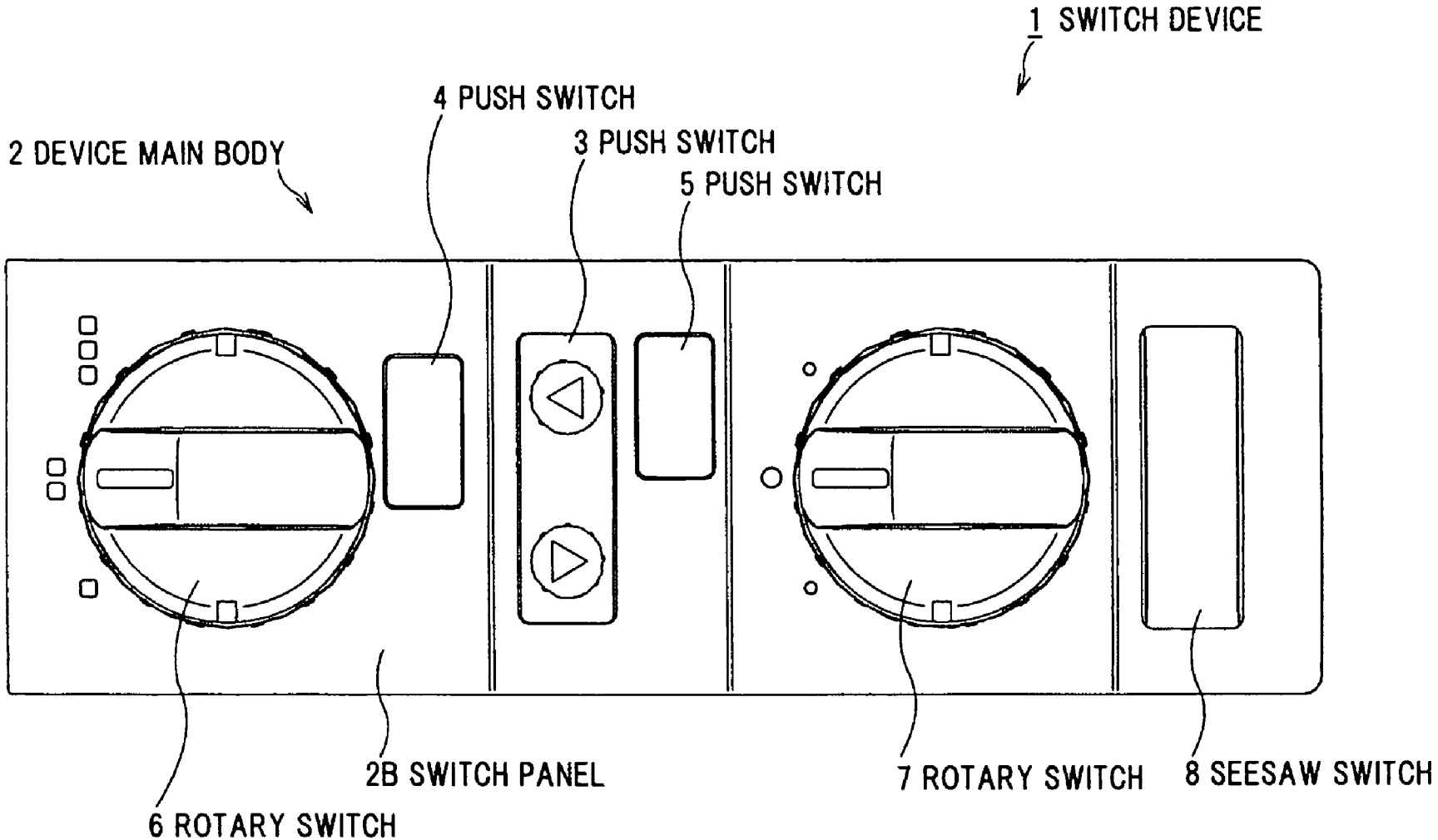
FIG. 1 is an explanatory plane view showing a total structure of a switch device in a preferred embodiment of the invention.
Figure 2:
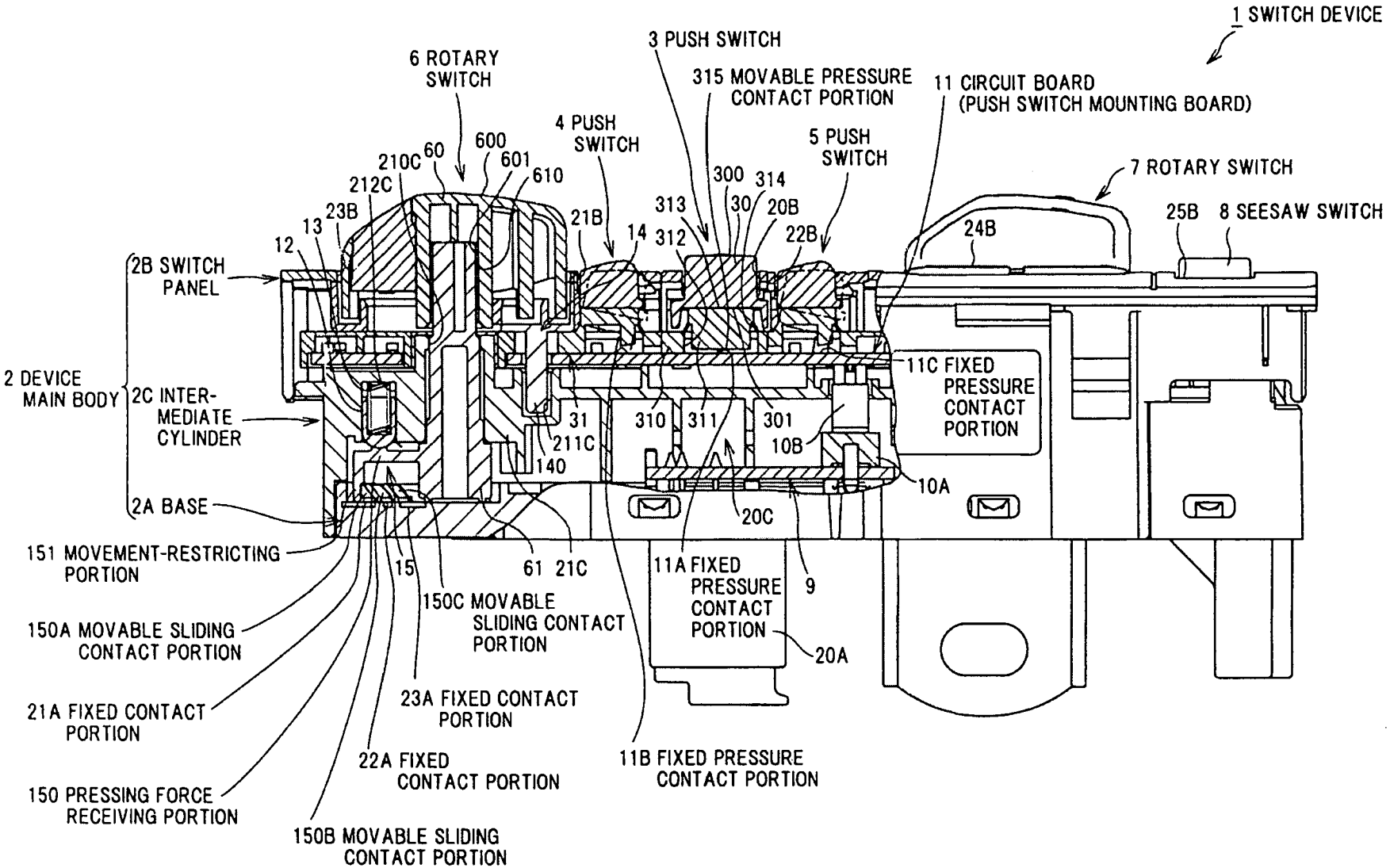
FIG. 2 is an explanatory cross sectional view showing a total structure of a switch device in the embodiment of the invention.
Figure 3:
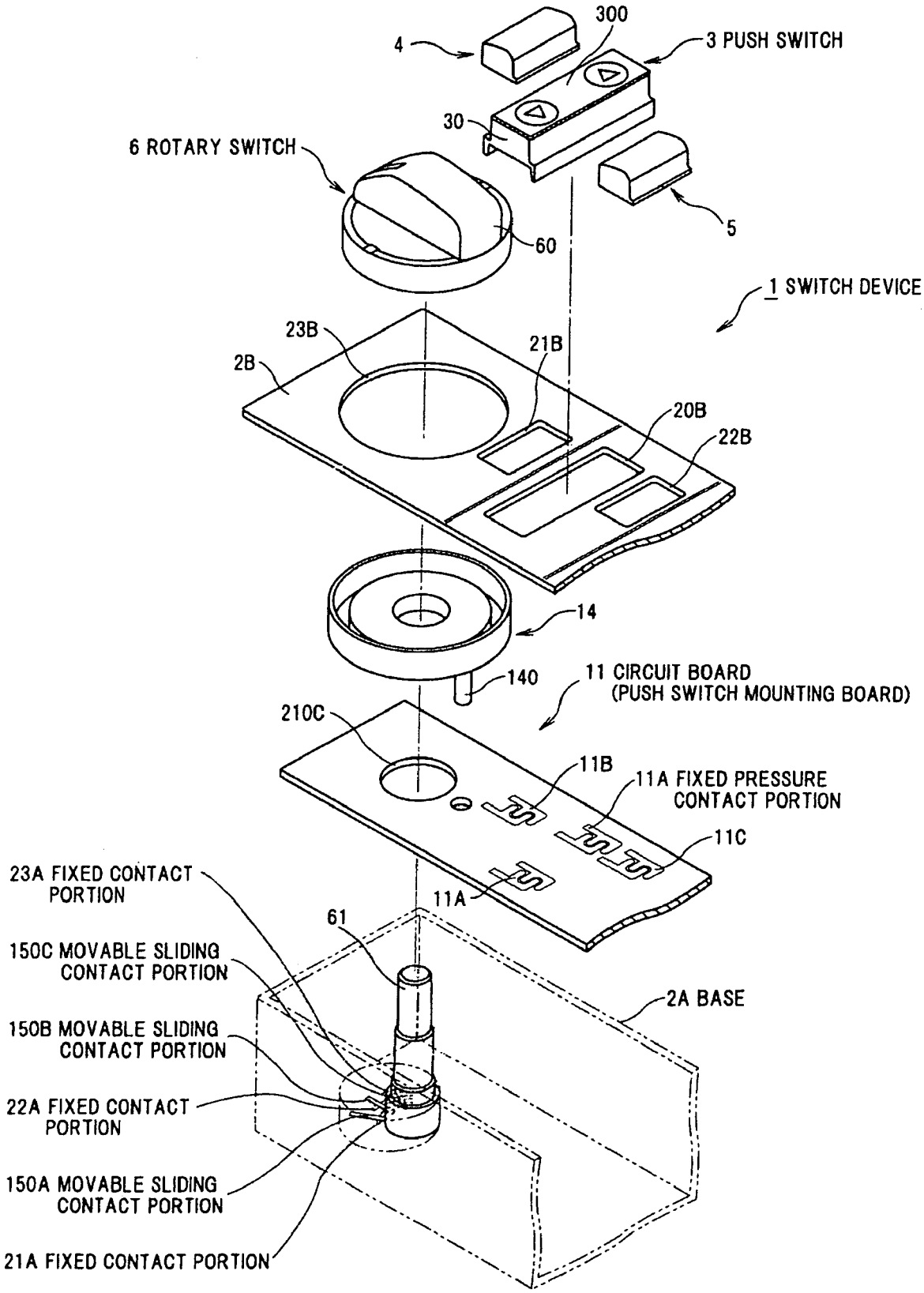
FIG. 3 is an explanatory exploded perspective view showing a total structure of a switch device in the embodiment of the invention.

FIG. 1 is an explanatory plane view showing a total structure of a switch device in a preferred embodiment of the invention. FIG. 2 is an explanatory cross sectional view showing a total structure of a switch device in the embodiment of the invention. FIG. 3 is an explanatory exploded perspective view showing a total structure of a switch device in the embodiment of the invention.

Total Structure of a Switch Device

In FIGS. 1 to 3, a switch device 1 is composed of a device main body 2, push switches 3, 4 and 5 as a pressure-operated switch, and rotary switches 6 and 7 (and a seesaw switch 8) as a slide-operated switch.

Structure of the Device Main Body 2

As shown in FIG. 2, the device main body 2 is composed of a base 2A forming a bottom portion of a case, a switch panel 2B forming a ceiling portion of the case by facing the base 2A and an intermediate cylinder 2C interposed between the switch panel 2B and the base 2A. The device main body 2 is composed of, e.g., a sealed case totally formed of a plastic (insulating) material such as PBT (polybutylene terephthalate) resin, etc.

The base 2A has a connector 20A for connecting to a vehicle ECU (electronic control unit), and is configured to allow a circuit board 9 to be supported on an inner surface of the base together with the rotary switches 6, 7 and the seesaw (slide operation type) switch 8. Fixed contact portions 21A, 22A and 23A for a sliding contact, which are connected to the connector 20A via a switch circuit (not shown) of the circuit board 9, are provided on the base 2A. Alternatively, the fixed contact portions 21A, 22A and 23A may be connected to the connector 20A (a terminal) via a conductive part (not shown) on the base 2A.

The switch panel 2B has knob insert holes 20B to 25B for letting each operating knob (described later) of the push switches 3, 4 and 5, the rotary switches 6, 7 and the seesaw switch 8 penetrate through, and is mounted on the intermediate cylinder 2C. The intermediate cylinder 2C has an internal space 20C for housing the circuit board 9, and is mounted on the base 2A. A retaining wall 21C for retaining a circuit board 11 connected to the circuit board 9 via connectors 10A and 10B composed of a housing and a terminal is provided in the intermediate cylinder 2C. A shaft insert hole 210C opened on a base side and a switch panel side, a locking concave portion 211C opened on the switch panel side and a concave hole 212C opened on the base side are provided on the retaining wall 21C. A pressure pin 12 for press-connecting knob holders (described later) of the rotary switches 6 and 7 with the base 2A is movably supported by the concave hole 212C. A snapping force to the base side is always imparted to the pressure pin 12 by a spring 13. Fixed pressure contact portions 11A, 11B and 11C are provided on the circuit board 11.

Structure of the Push Switches 3, 4 and 5

Since the configurations of the push switches 3, 4 and 5 are substantially same (a thickness of a coupling portion for coupling a rubber sheet and a switch functor is different), only the configuration of the push switch 3 will be explained as an example, and the explanation for the configurations of the push switches 4 and 5 will be omitted.

As shown in FIG. 2, the push switch 3 is composed of an operating knob 30 and a rubber sheet 31, is movably supported on the device main body 2 (the intermediate cylinder 2C) via the circuit board 11, and is configured to switch into a first or second switching state.

The operating knob 30 has a push-operation face 300 exposed to outside the device main body 2, and a push-operation force transmitting face 301 for transmitting a push operation power to the rubber sheet 31 (including a switch functor 311 described later). The operating knob 30 is mounted on the switch functor 311 and inserted into the knob insert hole 20B. Further, the operating knob 30 is construed to be dislocated in a push direction by a push operation or in a direction opposite to the push direction by releasing the push operation respectively.

The rubber sheet 31 has a sheet main body 310 and the switch functor 311. The rubber sheet 31 is arranged beneath the operating knob 30. The rubber sheet 31 is totally formed of, e.g., a plastic material made of a flexible insulating rubber such as silicone. The sheet main body 310 has a through hole 312 having a plane and circular shape that is opened along a central axis of the knob insert hole 20B. The sheet main body 310 is provided on an operating knob side surface (an upper surface) of the circuit board 11. The switch functor 311 has a push-operation force receiving face 313 which corresponds to the push-operation force transmitting face 301. The switch functor 311 is provided integrally with an upper opening periphery of the through hole 312 in the sheet main body 310 via a skirt-like coupling portion (thin wall part) 314. The switch functor 311 is construed to be dislocated to a position of the second switching state by the elastic deformation of the coupling portion 314 by the push operation of the operating knob 30, and to be returned to a position of the first switching state (an initial position) by the elastic deformation of the coupling portion 314 by releasing the push operation. At a lower end surface (a surface opposite to the push-operation force receiving face 313) of the switch functor 311, a movable pressure contact portion 315, which corresponds to the fixed pressure contact portion 11A and is formed of a conductive rubber, is provided.

Structure of the Rotary Switches 6 and 7

Since the configurations of the rotary switches 6 and 7 are substantially same, only the configuration of the rotary switch 6 will be explained as an example, and the explanation for the configuration of the rotary switch 7 will be omitted.

As shown in FIG. 2, the rotary switch 6 is composed of an operating knob 60 and a knob holder 61, is rotatably (slidably) supported on the device main body 2 (the base 2A and the intermediate cylinder 2C), and is configured to switch into a first, second or third switching state.

The operating knob 60 has a rotation operating portion 600 exposed to outside the device main body 2 and a rotational operation force transmitting portion 601 for transmitting a rotational operation force to the knob holder 61, is rotatably inserted into the knob insert hole 23B and is positioned at the knob holder 61. The operating knob 60 is configured to pivot in forward and reverse directions (clockwise and counter-clockwise) by a rotational operation. A sealing member 14 having a locking convex portion 140 inserted into the locking concave portion 211C by penetrating through the circuit board 11 is placed between an outer peripheral surface of the operating knob 60 (the rotation operating portion 600) and an inner peripheral surface of the knob insert hole 23B.

The knob holder 61 is slidably inserted into the shaft insert hole 210C and is slidably supported on an inner surface of the base 2A (a side surface of the fixed contact portion). A rotational operation force receiving portion 610 for receiving a rotational operation force from the rotational operation force transmitting portion 601 of the operating knob 60 is provided at an end portion of the knob holder 61 on the operating knob side. A pressing force receiving portion 150 for receiving a pressing force by the pressure pin 12 and a hook-shaped projection 15 having a movement-restricting portion 151 allowing the contact portion 23A to slide among the fixed contact portions 21A, 22A and 23A, are integrally provided at an end portion of the knob holder 61 opposite to the end portion on the operating knob side. Movable sliding contact portions 150A, 150B and 150C, which are composed of a conductive contact piece and each correspond to the fixed contact portions 21A, 22A and 23A for a sliding contact, are provided in the pressing force receiving portion 150. The movement-restricting portion 151 is integrally formed with the pressing force receiving portion 150 and is slidably supported on the fixed contact portion 21A.

Operation of the Switch Device 1

Since the operation of the switch device in the embodiment consists of "a push operation" and "a sliding (rotational) operation", "the push operation" will be explained in conjunction with the push switch 3 and "the sliding (rotational) operation" will be explained in conjunction with the rotary switch 6 respectively.

Push Operation

Firstly, when the push-operation face 300 (one side) of the operating knob 30 is push-operated by a finger of the operator in the first switching state of the push switch 3, the operating knob 30 is moved downwards to press the switch functor 311 (a direction that the movable contact portion 315 of the switch functor 311 approach the fixed contact portion 11A of the circuit board 11), and the coupling portion 314 is elastically deformed to be bent. Then, the switch functor 311 is moved downwards, so that the movable contact portion 315 contacts with the fixed contact portion 11A. Therefore, the movable contact portion 315 and the fixed contact portion 11A are electrically conducted, and the push switch 3 turns into the second switching state.

Next, when the push operation by the finger of the operator to the push-operation face 300 of the operating knob 30 is released in the second switching state of the push switch 3, the pressing state to the switch functor 311 by the operating knob 30 is released, and the coupling portion 314 is elastically deformed (returned) to an elongated state (the initial state). Then, the switch functor 311 is moved upwards (a direction that the movable contact portion 315 of the switch functor 311 is separated and distant from the fixed contact portion 11A of the circuit board 11), thereby separating from the fixed contact portion 11A. Therefore, the electrical conduction between the movable contact portion 315 and the fixed contact portion 11A is disconnected, and the push switch 3 turns into the first switching state.

Sliding (Rotational) Operation

Firstly, when the operating knob 60 (the rotation operating portion 600) is slidingly (rotationally) operated in a clockwise and counterclockwise direction by a finger of the operator in the first switching (neutral) state of the rotary switch 6, a rotational force of the operating knob 60 is transmitted to the knob holder 61, accordingly, the movable contact portions 150A, 150B and 150C contact with the fixed contact portions (fixed contact portions which correspond to a second or third switching state) 21A, 22A and 23A by sliding on the base 2A in an elastically deformed state. As a result, the movable contact portions 150A, 150B and 150C are electrically conducted to the fixed contact portions 21A, 22A and 23A, and the rotary switch 6 turns into the second or third switching state.

Next, when the operating knob 60 (the rotation operating portion 600) is slidingly (rotationally) operated in a clockwise and counterclockwise direction by a finger of the operator in the second or third switching state of the rotary switch 6, a rotational force of the operating knob 60 is transmitted to the knob holder 61, accordingly, the movable contact portions 150A, 150B and 150C are separated and distant from the fixed contact portions (fixed contact portions which correspond to a second or third switching state) 21A, 22A and 23A by sliding on the base 2A in an elastically deformed state, and contact with the fixed contact portions which correspond to the first switching state. As a result, the electrical conduction between the movable contact portions 150A, 150B and 150C and the fixed contact portions (fixed contact portions corresponding to the second or third switching state) 21A, 22A and 23A is disconnected, the movable contact portions 150A, 150B and 150C are electrically conducted to the fixed contact portions which correspond to the first switching state, and the rotary switch 6 turns into the first switching (neutral) state.

As described above, the push switch 3 and the rotary switch 6 corresponding to each type of operating knobs 30 and 60 are switched, and a switching signal is outputted from the push switch 3 and the rotary switch 6 to the vehicle ECU via the switch circuit (the connector 20A). The vehicle ECU outputs a driving signal to each type of drive portion based on the inputted switching signal. The drive portion inputs the driving signal from the control portion, thereby implementing the function thereof.

Effect of the Embodiment

In the embodiment according to the invention explained above, following effects can be obtained.

(1) Since the fixed pressure contact portion 11A is provided on the circuit board 11 and the fixed contact portions 21A, 22A and 23A are each provided on the base 2A, it is possible to prevent grease from reaching the fixed pressure contact portion 11A from the fixed contact portions 21A, 22A and 23A for a sliding contact due to an effect such as vibration after coating the grease, thereby preventing generation of a contact failure due to the grease between the fixed contact portion 11A and the movable pressure contact portion 315.

(2) Since the base 2A has the connector 20A, a dedicated connector for connecting to a vehicle ECU is not necessary, thus, it is possible to lower costs.

Although the switch device according to the present invention has been described based on the above preferred embodiment, the invention is not to be limited by the above embodiment and it is possible to implement in various features without going beyond a scope of the concept. For example, following variations can be made.

(1) In the embodiment, although it is explained that the rotary switches 6, 7 and the seesaw switch 8 are used as a slide-operated switch, the present invention is not limited thereto, and a slide switch also achieves the same effect as the embodiment.

(2) In the embodiment, although it is explained that the circuit boards 9 and 11 are connected each other by the connectors 10A and 10B composed of a housing and a terminal, the present invention is not limited thereto. Hence, circuit boards may be connected each other by a connector with a flexible substrate.

(3) In the embodiment, although the connection to the vehicle ECU is explained, the present invention is not limited thereto. Hence, similarly to the embodiment, it is possible to connect to an ECU other than the vehicle ECU.

(4) In the embodiment, although three pressure-operated switches and three slide-operated switches (the push switches 3, 4 and 5 as a pressure-operated switch and the rotary switches 6, 7 and the seesaw switch 8 as a slide-operated switch) are explained, the number of the pressure-operated switch and the slide-operated switch in the invention is, of course, not particularly limited.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A switch device, comprising:

a device main body incorporating a fixed pressure contact portion and comprising a fixed sliding contact portion that forms a circuit together with the fixed pressure contact portion; and at least one pair of switches supported on the device main body, each switch comprising an operating knob, wherein one switch of the at least one pair of switches comprises a pressure-operated switch comprising a movable pressure contact portion corresponding to the fixed pressure contact portion, another switch comprises a slide-operated switch comprising a movable sliding contact portion corresponding to the fixed sliding contact portion, wherein the device main body comprises a sealed case including a base forming a bottom portion of a case, a switch panel forming a ceiling portion of the case by facing the base and an intermediate cylinder interposed between the switch panel and the base, the fixed sliding contact portion being provided in the base, and the fixed pressure contact portion being provided in the intermediate cylinder.

2. The switch device according to claim 1, wherein the device main body houses a circuit board comprising the fixed pressure contact portion.

3. The switch device according to claim 1, wherein the device main body comprises a connector to be connected to the circuit.

4. The switch device according to claim 1, wherein the other switch comprises a knob holder provided with the movable sliding contact portion; and the knob holder is slidably supported on a side surface of a fixed contact portion of the base.

5. The switch device according to claim 1, wherein the other switch is a rotary switch in that an operating knob rotatably penetrates through the switch panel.

6. The switch device according to claim 1, wherein the switch panel comprises a knob inset hole letting the operating knob of the other switch penetrate through.

7. The switch device according to claim 6, wherein a sealing member is arranged in the knob inset hole of the switch panel, the sealing member being interposed between an inner peripheral surface of the knob inset hole and an outer peripheral surface of the operating knob of the other switch.

8. The switch device according to claim 1, wherein the other switch is a seesaw switch or a slide switch.

* * * * *